United States Patent [19]

Vann et al.

[11] Patent Number: 4,512,406

[45] Date of Patent: Apr. 23, 1985

[54] BAR ACTUATED VENT ASSEMBLY

[75] Inventors: Roy R. Vann; Flint R. George, both of Katy, Tex.; Dennis F. Warren, Albuquerque, N. Mex.

[73] Assignee: GEO Vann, Inc., Houston, Tex.

[21] Appl. No.: 385,705

[22] Filed: Jun. 7, 1982

[51] Int. Cl.[3] ..... E21B 43/116; E21B 43/26

[52] U.S. Cl. ..... 166/297; 166/55.1; 166/318; 175/4.56

[58] Field of Search ..... 166/297, 55.1, 55, 317, 166/318, 332, 369, 373, 386, 239; 175/4.56, 4.52, 2; 102/320–322, 328–330; 89/1 C

[56] References Cited

U.S. PATENT DOCUMENTS

| | | | |
|---|---|---|---|
| 2,493,650 | 1/1950 | Baker et al. | 166/318 |
| 3,054,415 | 9/1962 | Baker et al. | 166/318 |
| 3,151,681 | 10/1964 | Cochran | 166/332 |
| 3,198,254 | 8/1965 | Wise et al. | 166/239 |
| 4,031,957 | 6/1977 | Sanford | 166/318 |
| 4,176,717 | 12/1979 | Hix | 166/318 |
| 4,299,287 | 11/1981 | Vann et al. | 175/4.56 |

*Primary Examiner*—Ernest R. Purser
*Assistant Examiner*—Hoang C. Dang

[57] ABSTRACT

A vent assembly is positioned downhole in a borehole in underlying relationship with respect to a packer device. The vent assembly is connected within a production tubing string and a perforating gun is supported by the lower end of the string. A bar of special design is dropped down through the interior of the tubing and falls through the vent assembly and continues to fall down the tubing string to impact against a gun firing head. The action of the bar passing through the vent assembly moves structures associated therewith to cause a port to assume an open position. The subsequent impact of the bar against the gun firing head detonates the shaped charges of the gun. Formation fluid is then free to flow into the perforations, up the lower annulus, into the port of the vent assembly, and up the production tubing to the surface of the ground.

23 Claims, 10 Drawing Figures

FIG. 1
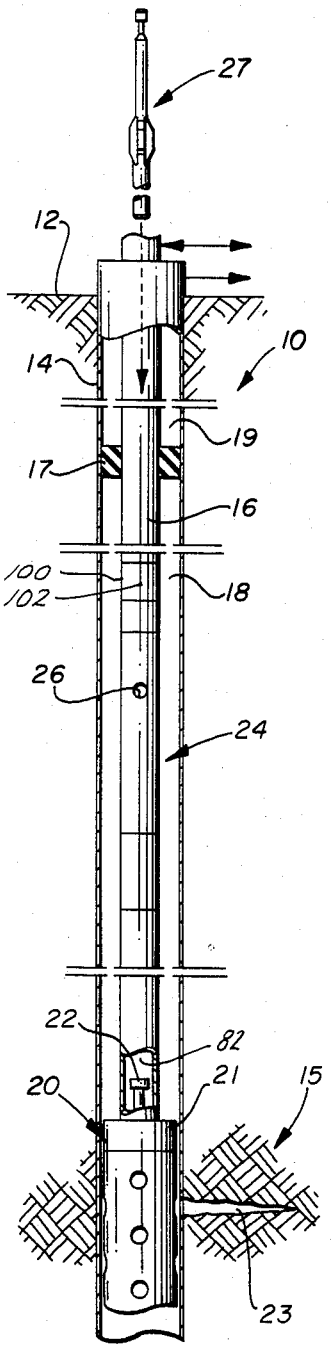
FIG. 2
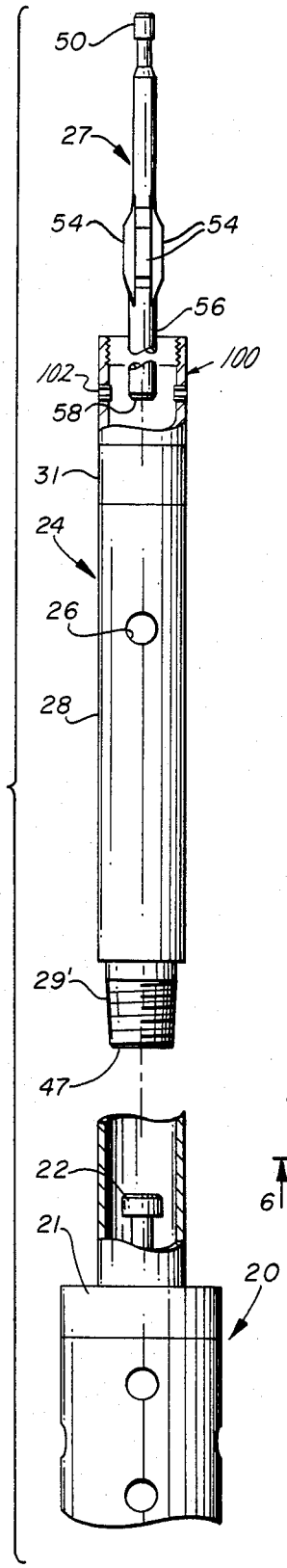
FIG. 3
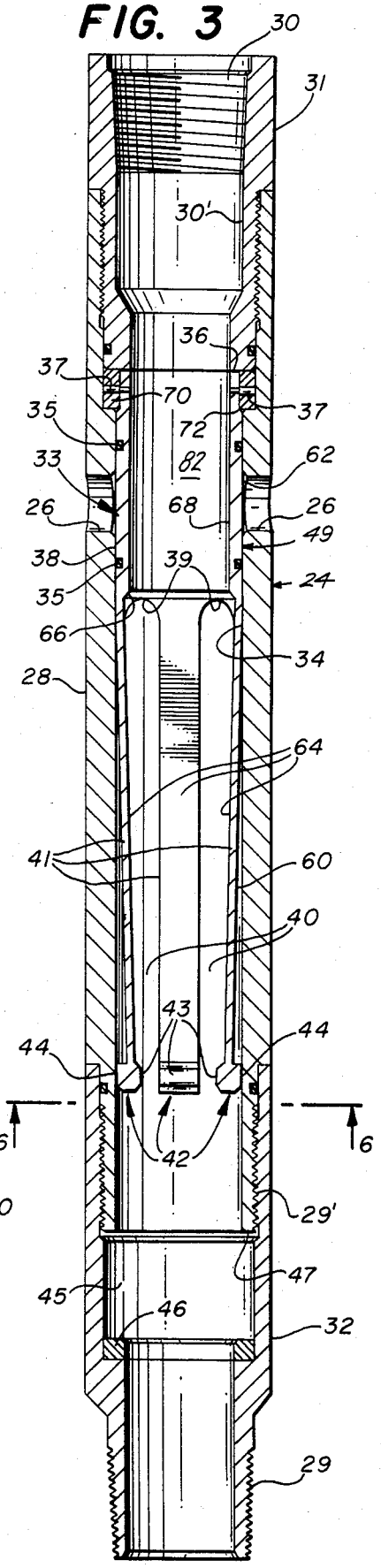
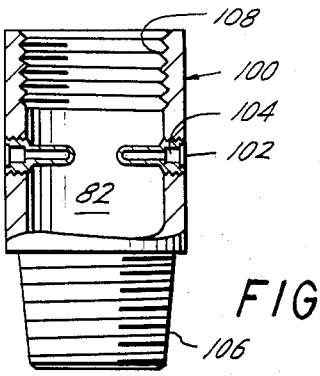
FIG. 10

BAR ACTUATED VENT ASSEMBLY

BACKGROUND OF THE INVENTION

In completing an oil and/or gas well, a perforating gun is lowered into the cased borehole and the well is perforated by shooting holes or perforations through the casing, cement and into the hydrocarbon formation to permit the hydrocarbons to flow into the cased borehole and up to the surface. Perforating objectives include perforations of a desired size and configuration, penetration of the formation at least beyond whatever contamination may have occurred during drilling and cementing, prevention of further formation invasion and contamination during the perforating process, and maximum capacity to move hydrocarbons from formation to wellbore.

The effects of drilling fluids, cementing material and procedures, and perforating fluids seem disposed to harm the movement of hydrocarbons from formation to borehole more than benefit such movement. During drilling of the borehole, formation pressures are controlled by a weighted drilling fluid, filtrate and perhaps fines which invade the formation, interacting with in situ solids and fluids to create a zone of reduced permeability, and leaving on the face of the formation a low-permeability filter cake. The cementing operation also includes fluids and fines which invade and damage the formation.

The perforating gun sends metallic particles, charge debris, gas, borehole fluid, and perhaps small amounts of casing, cement and filter cake material into the newly opened perforations. This mass of metallic particles moving in a jet stream at a high velocity exerts an impact pressure in the magnitude of millions of psi and displaces material in front of the jet radially. As the jet pushes aside the formation, a portion of the rock is crushed and intensely compacted into a low-permeability zone. When all the jet particles have entered the perforation, penetration stops. The result in metal is compaction and distortion and the result in rock is compaction, fracturing, and crushing. Around the actual hole in the formation is an envelope of crushed and compacted rock and around that envelope is an envelope of fractured and compressed rock. Around those layers or envelopes is fractured but uncompressed rock and beyond that is undisturbed formation. If it is held in place by a plug of mud, charge debris and other material under pressure, the envelope of crushed and compacted rock reduces productivity of the perforation.

Practically all of the metallic particles from the jet may remain in the perforation along with the other charge debris. Gun debris has nearly zero permeability. Although some of such debris may flow out of the perforations, much of the debris may remain lodged in the perforations. Swabbing may not create sufficient differential pressure, or sufficient fluid movement, to dislodge the debris from all perforations. Even if much of the gun debris is removed, the compacted zone may still remain. Such a compacted zone can reduce flow from a perforation to 30% of what flow would be if the compacted zone were either not there, or had the same permeability as the undisturbed rock. Thus, a well could be producing only 30% of its potential.

Where only a few perforations are open flow channels, flow velocity in those channels is higher, thus causing a tendency towards formation erosion and water coning. Due to low deliverability, the economics of the well can also be adversely affected by plugged perforations.

Where the formation pressure sufficiently exceeds the borehole pressure, the newly formed perforations can be backsurged to wash out and repel the debris. By flushing out the perforations, the flow channel through the perforation is increased in size thereby increasing productivity.

Through-tubing perforators, i.e., small guns that can pass through tubing, are used in the prior art. However, in such operations, differential pressure is usually limited to a few hundred psi to prevent a high velocity fluid surge that would sweep the gun uphole and tangle the cable. Only a few hundred psi toward the wellbore is not sufficient to flush out the compacted zone. Further, the small through-tubing perforating guns provide only a limited penetration in extra hard formations. In conditions where two casing strings, two cement sheaths, and hard rock must be penetrated, through-tubing perforators are virtually useless in establishing effective flow channels. In any event, the hydrostatic "holddown" pressure these guns require reduces the differential pressure available for cleanup.

High-powered casing guns have sufficient power to produce a deep perforation tunnel that penetrates beyond the mud-damaged zone. However, the added charge of a casing gun enhances the compaction, fracturing and crushing of the formation. The high-pressure jet stream compacts the rock around the perforating tunnel, and forces mud and cement contaminants into the formation. This extensive formation damage reduces native permeability and severly limits production.

After conventional jet perforations, the well operator often cleans the perforation by swabbing. Such swabbing will clean only a few holes, and will not create sufficient differential pressure to dislodge the compacted rock surrounding the perforation tunnel. When additional cleanup is necessary, acid is forced through the plugged hole, subjecting both the cement and the formation to higher injection pressure and increasing the chance of cement damage and bottom water production.

Perforation quality is more important than shot density or penetration. To overcome such perforation damage in consolidated formations, emphasis has been placed on perforating with high differential pressure toward the wellbore so as to flush out debris and compaction. Much higher energy is needed to dislodge the zone of low permeability crushed rock lining jet gun perforation channels.

The applicants have, since 1970, been developing a "Tubing Conveyed" completion technique. This technique allows the formation pressure to backsurge the perforations immediately following the detonation of the gun. This provides a deep clean perforation with the crushed zone and debris completely removed. This technique includes lowering into the well a packer and casing gun on a substantially dry string of tubing, setting the packer, bleeding off the pressure trapped below the packer, opening the dry tubing to flow, detonating the gun, and immediately producing the formation. This technique provides deeply-penetrating perforations and immediate cleanup with high backsurge pressures and maximum flow. The resulting high backsurge pressure provides enough energy to give near ideal perforations.

In operation, one or more casing guns are assembled for lowering adjacent the formation. A mechanical firing head is placed on the top gun and the assembly is run on dry tubing below a conventional packer. A tubing sub with a radioactive tag in the bottom collar is installed above the packer for positive depth positioning. All components in the system are measured before going into the hole. The strapped distance from the top shot to the radioactive collar is recorded.

Once the approximate perforating depth is reached by tubing measurements, a gamma-ray or neutron logging tool is run through the tubing. This log locates the exact position of the perforating assembly with respect to the open hole log from which the perforating intervals were selected. The system is then placed in the exact position with tubing subs. A vent assembly is attached below the packer and is run closed. This allows the tubing to be run dry or with whatever fluid blanket is required.

When the packer is set, the vent assembly is then opened. This exposes a plurality of large diameter ports in the vent and the vent becomes a perforated nipple for the production tubing string. Opening the ports relieves the hydrostatic pressure below the packer and gives the differential pressure for perforating. Since in a new well the cased borehole is shut off from the formation, the bottomhole pressure is now at substantially atmospheric pressure. If required, acidizing can be done through the vent assembly.

At the surface the blowout preventer is removed, the wellhead is installed, the flow line is staked, a flare bucket is lit and the tree cap removed. A detonating bar is then dropped through the tubing to fire the gun. A mechanical firing system is generally used which eliminates the risk of electrically detonated blasting caps.

Immediately following detonation of the guns, the high differential pressure to the wellbore badksurges debris, mud filtrate and other contaminants, along with any rathole fluid, to the surface. Backsurging can be done at the highest controllable pressure differential, often as high as 5,000 psi. Natural cleanup usually is finished quickly.

If sand erosion is expected, back pressure can be held with a fluid cushion in the tubing string. Nitrogen gas ($N_2$) may be used to hold back pressure during perforating and to "bring in" the well easily. Thus, the pressure differential may be predetermined by running the tubing into the well on closed, empty or partially fluid-filled tubing.

A tubing release is used to provide a safe, economical and dependable means of releasing the gun after perforation. This is important when a well requires stimulation, such as fracturing, and it is desirable to have the tubing open-ended so that ball sealers or other diverting agents can be used. Further, in dropping the guns, unrestricted gas flow may be allowed to the surface. In almost all cases, perforating is done with as much negative head as possible, surging the perforations to clean out damaging substances. Many times the guns are not dropped and are left in front of the producing zone to act as blast joints.

The Tubing Conveyed technique is designed for faster completion than conventional wireline methods. Tubing conveyed casing guns are designed for deeper penetrations and at multiple intervals in a single trip. The Tubing Conveyed technique avoids problems of the prior art such as wireline "stretch."

The Tubing Conveyed technique also assures safety. When the tubing is run, the packer is set, the blowout preventer removed, and the wellhead installed, all work at the surface is completed and tested for safety before the perforating guns are fired. These steps insure safety during all completions, especially those complicated by high bottomhole pressure or the presence of hydrogen sulfide. Prior art wireline methods require a delicate balance between expected formation pressure and casing fluid. Miscalculations when using through-tubing guns can result in the need to fish a tangled wireline. This may require pulling the tubing under adverse high-pressure conditions, and, if an overbalanced condition is used to perforate with a casing gun, some wells may "go on a vacuum," losing a large volume of fluid into the rock.

The Tubing Conveyed technique provides proper pressure differential which is needed to effectively clean perforations. Since all surface work is completed before the guns are fired, the differential pressure used to backsurge the perforation can be controlled. This permits cleaner wells and higher yields. The Tubing Conveyed technique may also be used in a highly deviated hole because the perforating assembly is lowered into the well on a tubing string and not a wireline.

The combination of hollow carrier gun for deep penetration and the flushing effect of 1,000 to 5,000 psi differential pressure produces near ideal perforations, i.e., long clean channels surrounded by formation that has not undergone permeability reduction by the penetrating media.

The Tubing Conveyed technique uses the raw power of virgin formation pressure to help solve the completion problems. The wells can be completed naturally without using extensive stimulation to overcome the damage from drilling, cementing, and perforating. Thus, wells can be completed in sensitive, problem formations where earlier completions were often impossible. Further, the Tubing Conveyed technique provides reliability, safety, speed, and overall economy that cannot be equalled by earlier completion methods. The technique is designed to immediately allow the safe release of formation pressure at maximum differential under the tubing. This backsurging cleans the perforation of mud filtrate, cement contaminants, and perforating debris, and allows each pay zone to produce at its full, natural capacity.

As indicated previously, formation pressures are often over several thousand psi and for safety reasons, as for example to prevent a blowout, a hydrostatic head is maintained in the cased borehole to provide a bottomhole pressure greater than the formation pressure. The hydrostatic head may be calculated by determining the weight of the column of mud in the casing. Although various means are provided to estimate the pressure of the formation, generally the hydrostatic head is maintained approximately 10% greater than that of the formation pressure.

However, in order to obtain a backsurge, the bottomhole pressure, i.e., the hydrostatic head, must be reduced to below that of the formation pressure. If the hydrostatic head were to be greater than the formation pressure at the time of well completion, well fluids in the casing would tend to flow into the formation, i.e., towards the lower pressure. One method of reducing the hydrostatic head is to displace the mud or other well fluid with a lighter fluid so as to reduce the hydrostatic head to a pressure less than the formation pressure.

As described earlier, in the Tubing Conveyed technique, the tubing string is lowered into the well substantially dry with the interior of the string being approximately atmospheric pressure. Upon setting the packer, the bottomhole pressure, caused by the hydrostatic head, is trapped beneath the packer. Unless that pressure is reduced, the bottomhole pressure will again be greater than the formation pressure preventing a backsurge.

One method taught by the prior art is to simultaneously open the dry tubing string at the time of perforation. Such a procedure has severe shortcomings. If the trapped bottomhole pressure is released suddenly at the time of perforation, a sudden pressure differential is created across the casing adjacent the formation as the trapped bottomhole pressure and formation fluids rush to the surface through the dry tubing string. This sudden pressure release causes a shock wave amounting to a kinetic force moving from the formation to the surface. Since the perforations through the casing are not large enough to take this shock force, the casing will, in most instances, collapse, ruining the well.

Further, the shock wave will tend to move the packer thereby causing the packer to lose its seal. Thus, a blowout could occur.

The preferred method is to vent the trapped bottomhole pressure below the packer prior to perforation. This release of the trapped bottomhole pressure permits the stresses, such as stress risers, in the casing to flow and distribute creating a static pressure differential across the casing rather than a dynamic pressure differential. Thus, the formation pressure becomes a static force around the casing rather than a dynamic force. By venting the trapped bottomhole pressure, the bottomhole pressure becomes substantially atmospheric pressure, creating a large static pressure across the casing. Upon perforation, the formation pressure is all vented through the perforations, permitting an enhanced backsurging.

The amount of time required to release the trapped bottomhole pressure varies with the formation pressure. In many wells, this trapped pressure may be released in a matter of seconds. For example, in the present invention, a bar actuated vent assembly is mounted on a 30-foot pipe section above the perforating gun. This pipe section is filled with clear fluids. As the bar drops through the tubing, it breaks kobes above the vent assembly to bleed pressure into the tubing string and then it engages the bar actuated vent assembly, and opens the vent assembly and tubing to fluid flow, thereby releasing the trapped bottomhole pressure. Because the pipe section is filled with fluid, the bar's descent is slowed due to the viscosity of the fluid. Thus, the bar's descent over the last 30 feet takes a second or two before the bar detonates the perforating gun. This time is sufficient to release the trapped bottomhole pressure and cause the bottomhole pressure to become atmospheric. The pressure differential across the casing then becomes static with a large pressure differential, i.e., the difference between atmospheric and the formation pressure. The greater the pressure differential, the better the backsurging and enhancement of well production.

It is necessary to have flexibility in the system. In some instances, it is desirable to have the tubing dry, and in others, to have a predetermined hydrostatic head in the tubing, or in others, to run the tubing in wet to control the well and then reduce the hydrostatic head in the tubing string for a predetermined underbalance.

Vent assemblies have multiple purposes. They can be used to keep the tubing string dry, they can be used as a perforated nipple, or they can be used to keep the tubing wet until one is ready to swab the tubing for perforation. It is of course important to insure that the casing does not collapse. Thus, in certain instances, such as that described above, the pressure must be bled off to open the vent assembly and then the vent assembly opened to release the trapped pressure below the packer.

It is preferred with blank casing having no perforations, to have kobes above the vent assembly which are clipped off as the bar drops through the tubing. Once the kobes are broken, small holes are opened in the tubing to permit the trapped pressure below the packer to bleed into the tubing string. The bar then travels on downward to open the vent and eventually fire the perforating gun.

However, where a producing well is being reperforated or old perforations are being surged, the cased borehole is open with the formation so that the bottomhole pressure and formation pressure tend to equalize. Thus, there is no differential across the casing and the kobes are eliminated to permit surging at the same instant as perforating. The objective is a controlled differential across the formation. In that situation, the bar is dropped, shear pins are sheared, the sleeve moves downwardly to open the vent assembly and the bar continues on to detonate the perforating gun. Thus, before the old perforations have had time to pressure up the entire system and raise the fluid level in the tubing string, the vent assembly is opened and the perforating gun is detonated simultaneously. At that time, the old perforations are surged and the new perforations are made with this underbalance practically at the same time.

The principal difference between a well that has never been perforated and a previously perforated well is that in the new well, the formation pressure cannot get into the casing and thus, it is necessary to open the vent assembly prior to perforating. However, in the case of an old well which has already been perforated, if the vent assembly is opened a substantial predetermined time prior to perforating, the formation pressure is vented into the borehole and into the tubing string so as to lose the differential pressure across the old perforation. In such a case, there would be little or no backsurging. Thus, one would want to keep the tubing string closed and dry as long as possible so that the new perforations could be made and the old perforations surged when there is a maximum pressure differential. In such a case, casing collapse would not be a problem.

Also, it may not be desirable to surge even a new well where there is unconsolidated sand. In such a situation, it may be desirable to only have a 500 psi differential.

Various vent assemblies of the applicant are disclosed in the prior art. Packer actuated vent assemblies are shown in U.S. Pat. Nos. 3,871,448; 3,931,855 and 4,040,485. U.S. Pat. No. 4,151,800 discloses a wireline actuated vent assembly and U.S. Pat. No. 4,299,287 discloses a bar actuated vent assembly. A pressure actuated vent assembly is the subject of U.S. patent application Ser. No. 166,547, filed July 7, 1980.

In U.S. Pat. No. 4,299,287, there is disclosed the combination of a gun firing head and a vent assembly which are sequentially moved to the operative position in response to impact of a free falling bar thereagainst. The vent assembly includes a sliding valve element which covers a port, and which is engaged by the falling bar and moved to the open position. The sliding valve element has no positive latch and therefore continues to fall toward the bottom of the hole with the bar. The bar ultimately impacts against the gun firing head, thereby detonating the shaped charges of the gun. Also, no means is provided to determine whether the vent assembly was opened or stayed open.

It has been found undesirable to allow the sliding valve element of the vent assembly to be carried downhole by the traveling bar for the reason that the valve element occupies a considerable amount of the annular area between the bar and the tubing string, thereby unduly reducing the velocity of the downward travel of the bar so that the bar does not always impact against the gun firing head with sufficient force to detonate the gun. This is especially so when debris partially obscures the trigger device of the gun firing head.

Moreover, it is undesirable to have the sliding valve element of the vent assembly disconnected from the tool string structure and translocated further downhole in the borehole because one can never be absolutely certain of the location of this metal sliding valve element and therefore, it is possible that certain complications could occasionally arise from this released piece of equipment. Further, the sleeve might hang up the bar or further slow its descent.

A combination bar actuated perforating gun and vent assembly is the subject of the present invention. The vent assembly is moved by the bar to the open position by the provision of a sliding valve assembly. The sliding valve assembly is moved and held firmly secured to the interior of the tubing at a predetermined location within the tubing string.

SUMMARY OF THE INVENTION

The method and apparatus of the present invention includes completing a hydrocarbon-containing formation, located downhole in a borehole, by running a perforating gun apparatus downhole on the end of a tubing string. A packer device divides the wellbore annulus into an upper and lower annular area. A vent assembly is connected in the tubing at a location above the gun and below the packer. Kobes are provided in the tubing string above the vent assembly for bleeding the pressure into the tubing string. The gun includes a firing head which detonates the shaped charges thereof in response to the impact of a falling weight.

The vent assembly includes a port which communicates the wellbore annulus with the interior of the tubing string when opened. A sliding valve element covers said port, and is movable in a slidable manner from a closed to an open position when the falling weight impacts thereagainst.

Means associated with the vent assembly causes the falling weight to engage and move the valve element a predetermined distance downhole, whereupon the valve element is released from the falling weight and the weight continues to fall downhole and subsequently impacts against the gun firing head and detonates the gun. The weight clips the kobes to bleed pressure into the tubing string.

In the preferred embodiment, the valve element is in the form of a slidable sleeve. Means on the sleeve engage the falling weight until the sleeve is moved a finite distance downhole by the momentum of the weight, whereupon the sleeve simultaneously releases the weight and latches into structure associated with the tubing string. The weight is free to continue traveling into abutting engagement with the gun firing head.

Accordingly, a primary object of the present invention is the provision of method and apparatus for completing a wellbore by sequentially opening a vent assembly and detonating a perforating gun.

Another object of the present invention is the provision of completing a well by dropping a weight down a tubing string and using the impact of the falling weight for sequentially opening a vent assembly and firing a perforating gun. Further, the bar moves the sleeve and passes through the vent assembly all in one action.

A still further object of the present invention is an unrestricted flow bore for the passage of the bar.

A further object of this invention is the provision of completing a well by engaging and arresting a falling weight with a vent assembly valve element, using the force of the impact for moving the valve element downhole to a specific location, releasing the weight from the valve element and latching the valve element to the wellbore tubing at the specific location, and thereafter engaging and arresting the falling weight with a gun firing head, and using the force of impact for detonating the shaped charges of the gun.

Other objects of the present invention include the provision of a positive latch located on the valve element of a vent assembly which prevents further travel of the valve element after the vent port is opened, and means to determine whether the vent has been opened and stayed open.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

BRIEF DESCRIPTION OF THE DRAWINGS

FIG. 1 is a fragmentary, part cross-sectional view of a borehole having apparatus therein made in accordance with the present invention;

FIG. 2 is an enlarged, disassembled view showing some parts of the apparatus seen in FIG. 1;

FIG. 3 is an enlarged, longitudinal, cross-sectional view of part of the apparatus disclosed in FIGS. 1 and 2;

FIG. 10 is a part cross-sectional view of the sub shown in FIG. 2.

DETAILED DESCRIPTION OF THE PREFERRED EMBODIMENT

Figure 4:
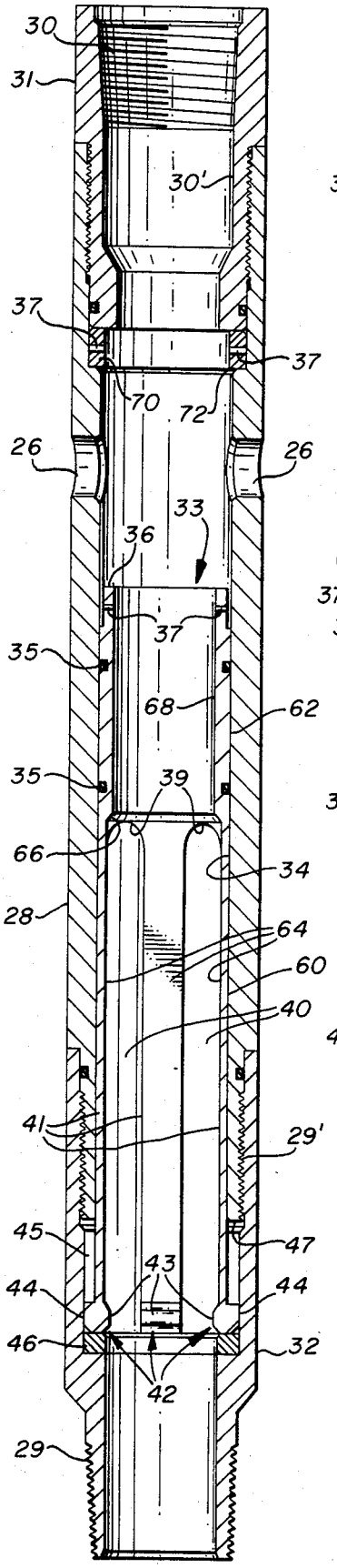
FIG. 4 is another longitudinal, cross-sectional view which discloses the tool of FIG. 3 shifted into the alternate position.

In FIG. 1 of the drawings, there is disclosed a borehole 10 which extends downhole from the surface 12 of the ground. The borehole 10 includes a casing 14 which isolates the wellbore from a hydrocarbon-containing formation 15. A tubing string 16 extends from the surface 12 of the ground concentrically through the casing 14. A packer device 17 divides the borehole annulus into a lower annulus 18 and an upper annulus 19.

A gun device 20 is supported at the lower end of the tubing string 16. The gun device 20 includes a firing head 21, preferably made in accordance with U.S. Pat. Nos. 3,706,344 and 4,009,757. The firing head 21 includes a trigger device 22 which is actuated in response to a weighted object being impacted thereagainst. Numeral 23 broadly indicates one of a multiplicity of tunnels or perforations which are formed when the shaped charges of the gun are detonated.

A vent assembly 24 has a series of ports 26 formed there within. The vent assembly 24 is series connected within the tubing string 16 in underlying relationship with respect to the packer device 17. Ports 26 are opened by vent assembly 24 in response to being impacted or abuttingly engaged by a falling weighted object 27, as will be more fully explained later on in this disclosure.

A sub 100 is series connected within tubing string 16 a predetermined distance above vent assembly 24. Although sub 100 is shown mounted just above vent assembly 24, Kobes 102 generally are located in the sub connected to the bottom of packer 17, with vent assembly 24 being series connected in the tubing string 16 approximately 60 feet below packer 17.

FIGS. 2 and 10 set forth the details of the sub 100. The sub includes one or more frangible members 102 which extend radially through the sidewall and into the axial bore 80 of tubing string 16. Frangible members 102 preferably are "Kobes" which are known to those skilled in the art of downhole tools and which are commercially available. Kobes 102 include an isolated pilot passageway 104 extending from the exterior of sub 100 communicating with the annulus 18 into the axial passageway or flow bore. Passageway 104 is opened by weighted object 27 clipping off that portion of members 102 extending into the flow bore 82. Upon opening of the passageways 104, the pressure trapped below packer 17 in the annulus 18 begins to bleed into the flow bore 82, or vice versa.

In FIGS. 2–9, there is disclosed further details of the vent assenmbly 24, the frangible members 102, falling weight 27, and gun firing head 21. As particularly disclosed in FIG. 3, the vent assembly 24 is seen to include a main cylindrical body 28 having opposed threaded ends, 29 and 30, at the lower and upper ends thereof. The upper and lower threaded ends preferably are in the form of an upper sub 31 and a lower sub 32 which enable the vent assembly 24 to be directly connected into the tubing string 16. Subs 31, 32 were put on each end of the assembly 24, as shown in FIG. 3, so that an easier connection could be made with a joint of pipe in the tubing string 16. Ends 29, 30 permit using any type of sub on each end of the assembly 24. As shown, in FIGS. 1 and 2, for example, sub 100 with frangible members 102 may be connected to upper sub 31 of FIG. 3.

Figure 5:
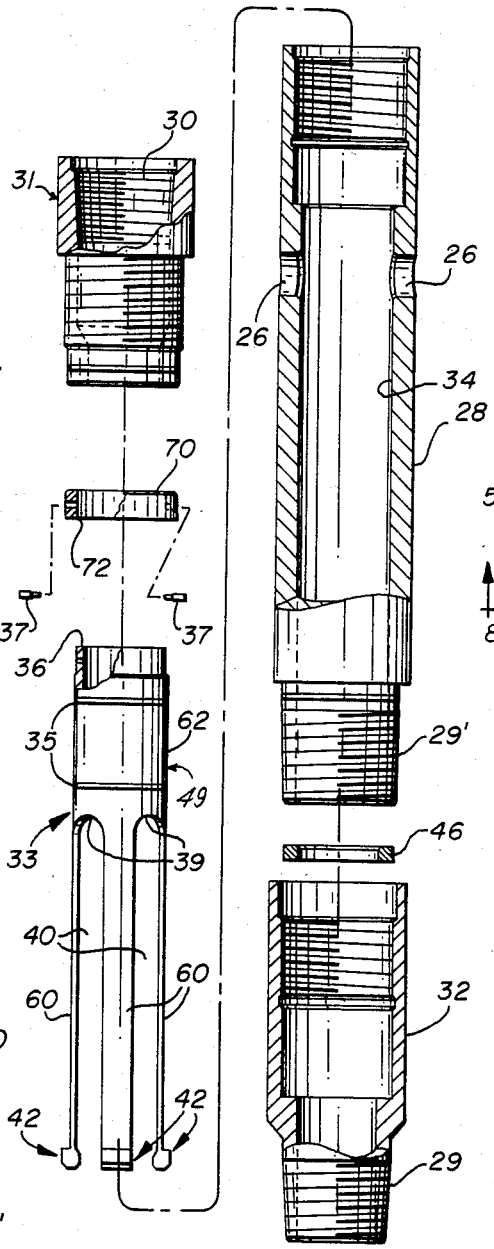
FIG. 5 is a reduced, part cross-sectional, exploded view of the tool of FIG. 4.

As seen in FIGS. 3–5, a sliding valve element 33 is slidably received in axially aligned relationship within the longitudinally extending axial passageway 82 of the main cylindrical body 28 and includes spaced o-rings 35 located uphole and downhole of the before-mentioned ports 26. Shear pins 37 releasably attach the sliding valve element 33 to the cylindrical body 28. The axial passageway 68 of element 33 forms a part of the axial bore 82.

The sliding valve element 33 includes an upper cylindrical part 49 which is in the form of a slidable sleeve 38. The sleeve 38 circumferentially extends 360° and forms the upper marginal end of the valve element 33. The upper cylindrical part 49 of the valve element 33 sealingly cooperates with the ported part of the main cylindrical body 28 to close th ports 26. The lower marginal end of the sliding valve element 33 is provided with the illustrated slots 40 which commence below the upper cylindrical part 49 thereof at 39 and extend through the lower terminal end thereof, thereby forming radially spaced apart legs 41, with the before-mentioned slots 40 being formed by the longitudinal edges or sides of the legs 41. Legs 41 are made from the same material as part 49. There should be sufficient tension in the legs 41 so that they will stay in the expanded position when the valve element is moved downwardly.

The lower marginal terminal end of the legs 41 preferably are enlarged at 42 in the illustrated manner of FIGS. 3–5. The enlargements 42 include an inner shoulder 43 and an outer boss 44, respectively, for engaging the falling weight 27 and the walls forming the annular cavity 45 of the lower sub 32, respectively. The annular cavity 45 is formed by the illustrated annular brass shock absorber 46, which is spaced from the lower terminal end 47 of the central portion of the main cylindrical body 28. Shock absorber ring 46 can be made of material other than brass so long as it serves as a suitable stop means. The brass is preferred because it absorbs part of the energy from element 33 as it moves downwardly and engages the ring 46. Ring 46 is soft enough that the bottom of legs 41 may become embedded in the brass and therefore ring 46 provides a cushioned stop. Were it not for the shock absorber 46, legs 41 could bend inwardly and partially restrict the axial bore 29 if the shock absorber ring 46 were not used.

The sliding valve element 33 is received against an upper stop ring 70 having a lower annular shoulder 72. Shear pins 37 extend through ring 70 and into the upper terminal end of sleeve 33. Shear pins 37 have dimensions which cause the pins to shear upon receiving a predetermined energy load from bar 27. Shear pins 37 are used for assembly purposes to hold the sleeve in the upper position.

Figure 6:
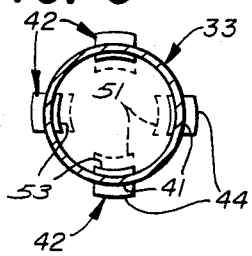
FIG. 6 is a cross-sectional view taken along line 6—6 of FIG. 3.

As seen in FIG. 4, the sliding valve element 33 is movable from a closed to an opened position. When the valve element 33 is forced in a downward direction, pins 37 are sheared, and the boss 44 of the enlargement 42 relaxes into cavity 45, thereby capturing the sliding valve element 33 within the main cylindrical body 28 in the opened configuration. FIGS. 5 and 6 further illustrate the operation of the valve element 33. In FIG. 6, the enlargements 42 have sprung from position 51 to 53 with boss 44 entering the cavity 45.

Figure 7:
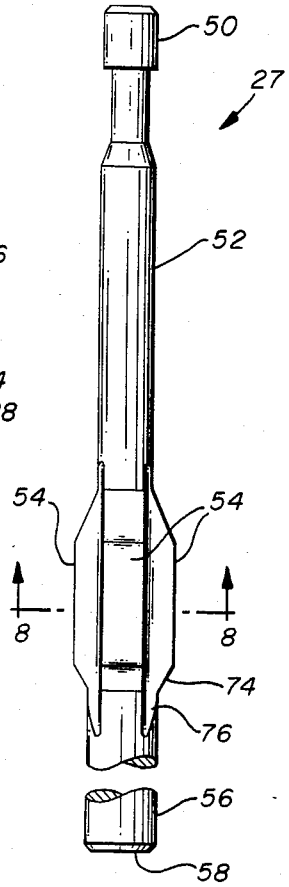
FIG. 7 is an enlarged, side elevational view of part of the apparatus seen in FIGS. 1 and 2.
Figure 8:
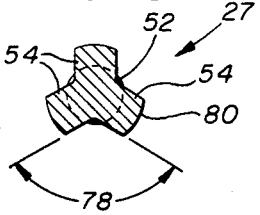
FIG. 8 is a cross-sectional view taken along line 8—8 of FIG. 7.

In FIGS. 7 and 8, there is disclosed the beforementioned weighted object or bar 27. The bar 27 is seen to include a fishing neck 50 located at the upper terminal end of a shaft 52. A medial portion of the shaft includes radially spaced apart fins 54. The lower terminal end 56 of the bar includes a lowermost face 58 which impacts against the before-mentioned trigger 22 when the bar 27 gravitates downhole into abutting contact therewith.

Looking again now to FIGS. 3–5, it will be noted that the legs 41 are provided with an outer surface 60 which is progressively spaced from the interior wall 34 of the body 28 when the port 26 is closed. The outer surface 60 of the valve element 33 becomes continuous as the legs 41 join the upper cylindrical part 49 of the valve element 33 located between the o-rings 35. Numeral 64 indicates the inner surface of the legs 41. The cylindrical inner surface 68 of upper cylindrical part 49 outwardly diverges at 66 at the upper end of the slots 40. The inner cylindrical surface 68 of the upper cylindrical part 49 provides part of the length of an unobstructed passageway or axial bore which extends down through the tubing string 16 from the wellhead to the gun firing head 21. The passageway 68 formed through part 49 is almost the size of flow bore 82 thereby restricting flow bore 82 to only a limited extent. In any event, passageway 68 and axial bore 80 is of ample diameter to receive the falling bar therethrough.

Looking again to the details of the traveling bar 27, numeral 74 indicates a lower edge portion of a plurality of radial fins 54 which are securely attached to shaft 52 of the bar 27. The fins 54 are reduced in area at 76 at each opposed marginal end thereof.

As seen in FIG. 8, there preferably are three radially spaced fins 54 circumferentially arranged in spaced apart relationship with respect to one another to provide spaced openings at 78.

Figure 9:
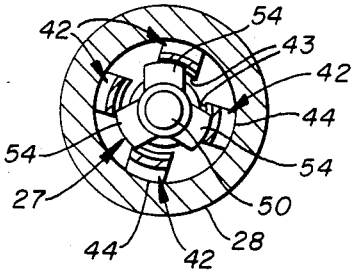
FIG. 9 is a schematical part cross-sectional representation showing the cooperative action between the apparatus of FIGS. 6 and 8.

FIG. 9 is a composite drawing of the traveling bar 27 and the sliding valve element 33. It will be noted that the configuration of the three fins 54 and the configuration of the four enlargements 42 will always cause a substantial surface area 74 of the fins 54 to engage a substantial surface area of the shoulder 43 of the enlargement 42 so as to transfer energy from the falling bar 27 into the sliding valve element 33 in an amount which is sufficient to shear pin 37 and move the sliding valve element 33 from the closed position of FIG. 3 into the illustrated opened position seen in FIG. 4. In the opened position, the boss 44 of the enlargement 42 expands into the annular cavity 45, thereby releasing the fins 54 from the legs 41 of the sliding valve element 33. This action captures the sliding valve element 33 at a specific downhole location and in the opened position and within the main cylindrical body 28, while the traveling bar 27 is released from the shoulders 43 and continues to fall towards the gun firing head 21. Thus a catch and positive latch are provided. The opening of vent assembly 24 and the release of bar 27 sequentially occurs all in one action.

In carrying out the method of the present invention, the vent assembly 24 is assembled into the illustrated tool string of FIG. 1 and placed downhole in the borehole 10. In the preferred embodiment, tubing string 16 will be substantially dry with the exception of fluid, such as water, in the lower 100 feet or less of the string to cushion the fall of bar 27. This fluid cushion protects the firing head trigger 22. A hydrostatic head greater than the formation pressure controls the well until the setting of the packer 17. Upon setting packer 17, the bottomhole pressure, caused by the hydrostatic head, is trapped beneath the packer. Unless that pressure is reduced to a pressure below the formation pressure, no backsurge will occur.

In the present invention, vent assembly 24 is located approximately 30 feet above perforating gun 20. The length of tubing string between gun 20 and vent 24 is filled with well fluid such that the column of fluid slows the descent of bar 27 between vent 24 and gun 20. Generally, a fluid cushion of about 60 feet is placed above the perforating gun 20. Since bar 27 travels approximately 20 feet per second through fluid, there is approximately 1 second to 2 seconds of time interval between the opening of vent assembly 24 and the detonation of gun 20.

In operation, bar 27 is dropped downhole through tubing string 16. Bar 27 first engages frangible members or kobes 102 in sub 100 and breaks or clips the ends of kobes 102 to open isolated passageway 104 whereby pressure in annulus 18 beneath packer 17 may bleed into flow bore of tubing string 16. Such bleeding of pressure reduces the differential pressure across sleeve 33 of the vent assembly 24.

As bar 27 moves further downwardly in flow bore 82, fins 54 on bar 27 engage shoulders 43 on enlargements 42 of sleeve 33. The impact of bar 27 against sleeve 33 shears pins 37 permitting sleeve 33 to move downwardly. As enlargements 42 pass downwardly to the level of cavity 45, legs 41 are resiliently biased into cavity 45 and subsequently engage shock absorber ring 46. As legs 41 expand into cavity 45, fins 54 and enlargements 42 disengage to permit bar 27 to pass further downwardly in flow bore 82.

Without Kobes 102 and the opening of vent assembly 24 prior to perforating, a sudden surge through vent assembly 24 and into tubing string 16 instantly removes the pressure below packer 17 such that packer 17 has no opportunity to adjust. Thus the immediate force from the hydrostatic head above packer 17 pushes packer 17 downwardly causing it to lose its seal with the cased borehole. Control over the well is then lost. Further, in a new well, a dynamic shock wave is applied to the casing from the formation before the distribution of the forces across the casing can occur. This shock wave may collapse the casing. Therefore, vent assembly 24 must be opened prior to perforating to slowly relieve the trapped pressure below packer 17.

The traveling bar 27 subsequently strikes the trigger 22 of the gun firing head 21 and the impact thereof detonates the shaped charges of the gun 20, whereupon a plurality of perforations 23 are formed through the casing 14 and into the formation 15.

Production occurs from the formation 15, into the tunnels of the perforations 23, into the lower annulus 18, into the ports 26 of the vent assembly 24, and up through the tubing string 16 and to the surface 12 of the ground.

While a preferred embodiment of the invention has been shown and described, modifications thereof can be made by one skilled in the art without departing from the spirit of the invention.

I claim:

1. In cased wellbore having a wellhead and a perforating gun suspended adjacent to a hydrocarbon-containing formation by a tubing string, the casing and tubing string defining a casing annulus therebetween, the gun having a firing head actuated by impact, a packer which divides the casing annulus into an upper and a lower annulus, and a vent assembly underlying the packer and connected in series relationship within the tubing string, the improvement comprising:

said vent assembly includes a main body having an axial passageway formed therethrough, a port formed into said main body which communicates the lower annulus with the tubing interior, a sliding valve element in the form of a sleeve slidably received within said axial passageway and movable in a slideable manner from an upward closed position which closes said port against flow to a lower opened position above the gun firing head and from which the sleeve is prevented from further downward motion, which opens said port for flow therethrough;

a bar having a longitudinally disposed body which can be received in axially aligned relationship within the tubing string, a leading end of the bar being of a configuration to impact against the gun firing head; means formed on said main body, said sleeve, and said bar for engaging said sleeve with the bar to move the sleeve due to the inertia of the falling bar a limited distance in a downhole direction to said lower opened port position whereupon the sleeve is then released from the bar and latched to said main body so that the port in said main body is not substantially closed after bar engagement, while the bar is free to fall towards the gun firing head;

so that the bar can be dropped down through the tubing string, whereupon the bar engages and moves the sleeve to the opened position; the bar is then released from the sleeve and continues to travel downhole where the bar impacts against the gun firing head to actuate the gun and perforate the casing, and flow can then occur from the hydrocarbon-containing formation, through the perforations, up the lower annulus, into the port of the vent assembly, up the tubing string, and to the wellhead where the produced hydrocarbons can be gathered.

2. The improvement of claim 1 wherein said sliding sleeve is releasably connected to the main body of the vent assembly by a shear pin; and, circumferentially extending seals are positioned between the interior of the main body and the exterior of the sliding sleeve to thereby seal said port and prevent flow from occurring therethrough when the valve element is in the closed position.

3. The improvement of claim 1 wherein said bar includes a lower end adapted to impact against the gun firing head, and a plurality of circumferentially spaced apart radial fins having a maximum diameter which is smaller than the minimum diameter of the tubing;

said fins have a leading edge which terminates in a shoulder, with the shoulder being of a configuration to jointly engage structure of the sliding sleeve.

4. The improvement of claim 3 wherein said main body has an annulus formed in spaced relationship respective to said port, said sliding sleeve includes a finger extending therefrom and terminating in an outwardly directed member which latches into said annulus when the sleeve is moved into the opened position.

5. The improvement of claim 1 wherein said main body has an annulus formed in spaced relationship respective to said port, said sliding sleeve includes a plurality of resilient fingers extending therefrom and terminating in an inwardly directed shoulder for engaging the bar, and an outwardly directed boss which latches into said annulus when the sleeve is moved downhole into the opened position.

6. The improvement of claim 1 wherein said sliding valve element has a marginal upper end made into said sleeve and a marginal lower end made into a plurality of outwardly biased legs, the legs being formed by longitudinally extending slots; the lower end of the legs having a shoulder formed on the inner surface thereof and a boss formed on the outer surface thereof;

said main body has an annulus formed therein in spaced relationship respective to said port, said annulus inwardly opens into the axial passageway of said main body, said annulus receives said boss in captured relationship therewithin when said valve element is moved downhole to the open position;

said bar includes radial fins, a shoulder formed on said fins for engaging the shoulder formed on said leg;

the leg shoulder being biased away from the axial centerline of the main body and forced towards one another when the valve element is in the closed position, to thereby move away from the axial centerline of the main body when the boss is received within said annulus;

whereby the bar shoulder and valve element should engage one another to force the sleeve to move downhole and into the open position, and said bar shoulder is then released from said valve element shoulder when said boss enters said annulus, thereby latching said valve element in the opened position while said bar is free to fall towards the gun firing head.

7. In a cased wellbore having a perforating gun suspended on an end of a tubing string, said gun being located adjacent to a hydrocarbon-containing formation; the casing and tubing string defining a casing annulus therebetween; said gun having a firing head which is actuated by impact, a packer device which divides the casing annulus into an upper and a lower annulus; the combination with said packer and perforating gun of a vent assembly and a traveling bar;

said vent assembly is located in underlying relationship respective to the packer, and connected in series relationship respective to the tubing string; said vent assembly includes a main body having a port formed therein by which the lower annulus can communicate with the tubing interior when the port is opened; a sliding sleeve covering said port and preventing flow therethrough when in an upper closed position and uncovering said port to permit flow therethrough when in a lower open position above the gun firing head and from which the sleeve is prevented from further downward motion; means on said traveling bar for engaging said sliding sleeve to move it due to the inertia of the bar, in a downhole direction to said open position, means on said bar for impacting against the gun firing head;

means formed on said main body and said sliding sleeve by which said sleeve is released from said bar and latched to said main body when said sleeve is moved to the open position so that the port is not substantially closed after bar engagement;

whereby, said bar can be dropped down through the tubing string where it sequentially engages and moves the sliding sleeve to open the port, whereupon the sleeve is locked into the open position and releases said bar which subsequently impacts against the gun firing head to detonate the gun and cause the casing to be perforated, thereby enabling hydrocarbons to flow from the formation, through the perforations, up through the lower annulus, through the opened port, into the tubing string, and uphole to the top of the wellbore.

8. The combination of claim 7 wherein said sliding sleeve includes means by which it is slidably received in a sealed manner respective to the main body of the vent assembly, including circumferentially extending seals positioned between the interior of the main body and the exterior of the sliding sleeve to thereby seal said port to prevent flow from occurring between the interior of the tubing string and the lower casing annulus.

9. The combination of claim 7 wherein said main body includes an inwardly directed latch cavity formed in spaced relationship respective to said port, said bar includes a lower end adapted to impact against the gun firing head, and a plurality of spaced apart radially arranged fins having a maximum diameter which is smaller than the minimum diameter of the tubing;

said sliding sleeve includes a plurality of resilient fingers depending therefrom which are biased outwardly against the interior of said main body; a cavity-engaging member formed at marginal terminal ends of said fingers for entering said cavity and latching said sliding sleeve in the opened position, while concurrently releasing the bar from the sleeve;

said fins include a leading edge which terminates in a shoulder, with the shoulder being of a configuration to jointly engage the ends of the resilient fingers.

10. A method of completing a well to a hydrocarbon-containing formation located downhole in a cased borehole, comprising:

running a casing gun downhole into proximity of the formation; attaching to the gun a firing head which is responsive to impact;

dividing the casing annulus into a lower and upper annulus by using a packer device;

positioning a vent assembly in series relationship respective to the tubing string, and locating the vent assembly below said packer device; the vent assembly having a port therethrough; the port being closed by a slidable valve element;

dropping a traveling bar down the tubing string and using the momentum of the bar for moving the sliding valve element downhole to a position from which further downward movement of the sliding valve element is prevented and the port is opened such that it is not substantially closed to fluid flow after bar engagement with the sliding valve element, and subsequently releasing the bar from the sliding valve element and using the momentum of the traveling bar for detonating the firing head, so that the casing gun perforates the casing, produced fluid flows from the hydrocarbon-containing formation, into the lower casing annulus, uphole into the opened port of the vent assembly, into the tubing string, up the tubing string to the surface of the ground, thereby completing the wellbore.

11. The method of claim 10 wherein said sliding valve element releaseably engages the bar and thereafter is latched in the open position as the bar is released after the port is uncovered.

12. The method of claim 11 and further including the steps of retaining the sliding valve element in spaced relationship respective to the port after the bar has been released from the valve element.

13. A method of completing a well having a cased borehole comprising the steps of:

(1) suspending a perforating means, vent means and packer means on a tubing string within the cased borehole of the well;

(2) positioning the perforating means adjacent a desired formation;

(3) setting the packer means within the cased borehole thereby trapping fluid pressure beneath the packer means;

(4) releasing the trapped fluid pressure beneath the packer means and forming a flow path which communicates the borehole below the packer means with the interior of the tubing string by moving a barrier within the vent means from a closed position to an open position above the perforating means and beneath the closed position due to inertia of a bar dropped through the tubing string;

(5) releasing the bar from the barrier when the barrier has moved to the open position to permit the bar to fall further;

(6) preventing further downward motion of the sleeve when it has reached the open position and retaining it in said open position so that the flow path is not substantially closed after bar engagement;

(7) actuating the perforating means with the falling bar to communicate the borehole beneath the packer means with the formation; and (8) producing the formation through the flow path of step (4) immediately upon carrying out step (7).

14. In a wellbore which penetrates a hydrocarbon-containing formation, the method of completing the formation comprising the steps of:

(1) suspending a subsurface perforating means and packer means from a tubing string;

(2) setting the packer means within the borehole at a position which enables the packer means to isolate a lower portion of the borehole and which positions the perforating means adjacent the formation;

(3) using the interior of the tubing string as a passageway to open a flow path which communicates the lower portion of the borehole with the interior of the tubing string by dropping a bar down the tubing string to impact a means for moving a barrier to the flow path from a closed position to an open position due to the inertia of the bar and thereafter;

(4) preventing further motion of the barrier from the open position to the closed position so that the flow path is not substantially closed after bar impact and thereafter;

(5) using the interior of the tubing string as a passageway through which the perforating means is caused to be actuated so as to communicate the lower portion of the borehole with the formation; and (6) producing the formation along the flow path of step (3) immediately upon carrying out step (5).

15. The method of claim 14 and further including after step (2) the step of using the interior of the tubing string as a passageway to form at least one bleed port through the tubing string thereby permitting the pressure around the tubing string to bleed into the interior of the tubing string.

16. A vent assembly for opening a tubing string to fluid flow comprising:

a body having an axial passageway and radial ports therethrough;

a sliding valve element slidably received within said passageway movable from a closed position closing said radial ports to an open position opening said radial ports to fluid flow due to the inertia of an object falling through the passageway; and latch means for preventing the movement of said valve element from said open position to said closed position after passage of the object through the axial passageway.

17. The vent assembly of claim 16 wherein said valve element includes projection means extending into said passageway for engaging said object dropped through said passageway.

18. The vent assembly of claim 17 wherein said body includes means for receiving said projection means whereby said object disengages said projection means.

19. The vent assembly of claim 18 and including bleed port means for reducing the pressure differential across said body prior to moving said valve element from the closed to the open position.

20. The vent assembly of claim 16 and including shear means for holding said valve element in said closed position and for releasing said valve element for moving into said open position.

21. The vent assembly of claim 16 wherein said valve element includes latch means biased inwardly in said closed position and unbiased in said open position.

22. The vent assembly of claim 21 wherein said latch means includes a plurality of downwardly extending legs having inwardly and outwardly extending projections on the lower terminal ends thereof.

23. The vent assembly of claim 16 and including shock absorber means for absorbing the energy of the movement of said valve element from the closed position to the open position.

* * * * *